United States Patent [19]

Mathijssen

[11] 4,038,578

[45] July 26, 1977

[54] SHORT-ARC DISCHARGE LAMP WITH ELECTRODE SUPPORT STRUCTURE

[75] Inventor: Petrus Johannes Mathijssen, Eindhoven, Netherlands

[73] Assignee: U.S. Philips Corporation, New York, N.Y.

[21] Appl. No.: 692,058

[22] Filed: June 2, 1976

[30] Foreign Application Priority Data

June 5, 1975 Netherlands ..... 7506655

[51] Int. Cl.[2] ..... H01J 61/06; H01J 61/16; H01J 61/30

[52] U.S. Cl. ..... 313/217; 313/220; 313/224; 313/253

[58] Field of Search ..... 313/184, 217, 224, 220, 313/289, 253, 258

[56] References Cited

U.S. PATENT DOCUMENTS

| | | | |
|---|---|---|---|
| 3,315,116 | 4/1967 | Beese | 313/217 |
| 3,488,546 | 1/1970 | Paquette | 313/217 X |
| 3,515,928 | 6/1970 | Kershaw | 313/184 |
| 3,517,248 | 6/1970 | Eckel | 313/214 X |
| 3,518,480 | 6/1970 | Paquette | 313/217 X |

*Primary Examiner*—Palmer C. Demeo

*Attorney, Agent, or Firm*—Frank R. Trifari; Robert S. Smith

[57] ABSTRACT

Rare gas-filled short arc discharge lamps comprise in the neck-shaped portions of the lamp envelope a supporting member for the electrode pin which is connected neither to the wall of the lamp envelope, nor to the electrode pin. The supporting member is fixed against axial displacement. The member may consist of quartz glass, ceramic, a high-melting point metal.

Due to this construction the manufacture of lamps is considerably simplified and critical steps are avoided.

7 Claims, 8 Drawing Figures

SHORT-ARC DISCHARGE LAMP WITH ELECTRODE SUPPORT STRUCTURE

The invention relates to a short-arc discharge lamp having a rare gas-filled quartz glass lamp envelope comprising a portion enclosing the discharge space and two neck-shaped portions via which electrode pins which support the electrodes and which are led through the wall of the lamp envelope in a vacuum-tight manner extend to in the discharge space, a cylindrical supporting member through which the electrode pin is led being present in the neck-shaped portions.

Characteristic of short-arc discharge lamps is that the distance between the ends of the electrodes is smaller than the distance from the ends to the wall of the lamp envelope. The electrodes are heavy, in particular the anode of direct current lamps, and the electrode pins are long. As a result of this, large forces are exerted on the vacuum-tight lead-through of the electrode pins through the wall of the lamp envelope. This gives easily rise to the formation of cracks in the seal, as a result of which the lamp will leak.

According to Swiss Pat. Specification No. 397081 this is prevented in that a cylindrical supporting member through which the electrode pin is led is provided in the neck-shaped portions of the lamp envelope. The supporting member consists of a quartz glass cylinder which is fused with the wall of the lamp envelope. The cylinder has continuous recesses along its jacket and/or axial bores so that gas transport from the discharge space to the space in the neck-shaped portion behind the supporting member, and conversely, can easily take place. These ducts would also be necessary to evacuate and gas-fill the lamp envelope during the manufacture of the lamp.

The fusion of the quartz glass supporting member with the wall of the lamp envelope is a particularly critical step in the manufacture of the lamp. Considerable stresses may occur in the quartz glass so that cracks easily occur.

U.S. Pat. No. 3,250,941 discloses a short-arc lamp in which the anode bears against the wall of the lamp envelope by means of an expanded turn of a wire which is wound in a clamping manner around the anode. The primary object of this wire is to center the anode during the manufacture of the lamp, in particular upon making the vacuum-tight lead-through of the anode pin.

The coiled wire as a supporting member in the finished lamp is not very effective, since a coil will give way when shocks occur as a result of which forces will nevertheless be exerted on the vacuum-tight lead-through of the electrode pin.

It is to be noted that in this lamp also the discharge space is in open communication with the space behind the supporting member.

As disclosed in the preamble of the above-mentioned Swiss Pat. Specification No. 397081, lamps are also known in which the electrode pins are supported by allowing the wall of the neck-shaped portions of the lamp envelope to collapse onto the electrode pins after heating. Some clearance must however remain between the wall and the electrode pin due to differences in thermal expansion of the material of the two parts. This construction not only involves a very critical step in the manufacture, which requires great skill, but in addition the lamps in which said construction is used are less suitable to be clamped unilaterally in a horizontal operating condition. Another drawback is that during the manufacture of the lamp it is difficult to remove air from the dead space behind the support.

Furthermore, lamps are on the market in which the electrode pins are supported on the wall of the neck-shaped portion of the lamp envelope by means of a cylindrical, solid, tungsten member which is immovably secured to the pins by soldering or welding. A drawback of this construction is that as a result of the high temperatures which have to be used during welding or soldering, recrystallization occurs in the electrode pins. As a result of this they will become brittle and easily break when the lamp is subjected to shocks.

Finally, short-arc discharge lamps of quite a different nature are known from U.S. Pat. No. 3,636,395. The lamp vessel in these lamps has a cylindrical shape and is of ceramic material for the greater part. The electrode units in these lamps are particularly large and heavy. They consequently require much material. The electrode units have a cylindrical part the diameter of which is approximately equal to the inside diameter of the lamp vessel. A helically wound wire is accommodated in a circumferential groove in said cylindrical part so as to support the electrode against the wall of the lamp vessel. In addition to the drawback of these electrode units requiring much material, they also are complicated in shape.

It is an object of the invention to provide short-arc lamps having a reliable electrode pin support which support is considerably easier to manufacture and without this involving a critical step.

According to the invention, short-arc discharge lamps of the kind mentioned in the preamble are characterized in that the cylindrical supporting member is connected neither to the wall of the neck-shaped portion, nor to the electrode pin, and that means are present to fix the supporting member against axial displacement.

In the lamps according to the invention the supporting member is hence simply slid on the electrode pin and the pin with the supporting members are slid into the neck-shaped portion of the lamp envelope. Treatments for securing the supporting member to the electrode pin or to the wall of the neck-shaped portion, which might make the lamp sensitive to shocks, are therefore not necessary.

In order to prevent the supporting member from moving in the axial direction, as a result of which it would lose its function entirely or partly, means are present to avoid said movement. These means may be of a variety of natures, for example a. a wire wound around the electrode pin and extending from the electrode to the supporting member or from the supporting member to the end of the neck of the lamp envelope.

b. a stretched wire between the supporting member and the electrode or between the supporting member and the end of the neck of the lamp envelope, which wire is locally wound once or several times around the electrode pin, c. a wire wound in a clamping manner around the electrode pin in front of (between supporting member and electrode) or behind the supporting member, d. one or more re-entrant parts in the wall of the neck of the lamp envelope for the local reduction of the diameter of the neck (since said re-entrant part need not extend throughout the circumference, it does not involve a weakening of the lamp envelope), e. a, for example triangular, bent resilient wire which clamps against the wall of the neck-shaped portion or is fixed in a ridge or salient part provided therein, f. a tube of quartz glass, ceramic or a high-melting-point metal slid on the electrode pin, which tube may be bevelled at the end engaging the supporting member, The wire used to fix the supporting member may be of metal which can withstand high temperatures, for example, tungsten, molybdenum, tantalum, titanium, and the like.

The clearance between the electrode pin and the supporting member and between the supporting member and the wall of the neck-shaped portion is preferably not larger than is necessary with a view to differences in thermal expansion between the materials used. If the supporting member is of the same material as the electrode pin, the diameter of the bore in the supporting pin may therefore be equal to the diameter of the electrode pin. This may also be the case, for example, if the coefficient of expansion of the material of the supporting member is larger than or equal to that of the material of the electrode pin. In a preferred embodiment the supporting member does not comprise axially extending channels other than for leading-through the electrode pin and separates the space behind the supporting member from the discharge space with the exception of the slots between the wall and the supporting member and between the supporting member and the electrode pin. It has actually been found that as a result of this a quieter discharge arc is obtained. This is ascribed to the considerable restriction of the possibility that comparatively cold gas from the neck-shaped portion of the lamp envelope mixes during operation with the hot gas in the discharge space.

On the other hand it has been found that the narrow slots via which the discharge space and the space in the necks of the lamp envelope communicate with each other constitute no impedance for the evacuation and rare gas-filling of the lamp envelope via one exhaust tube which for optical reasons is preferably provided on one of the neck-shaped portions of the envelope. This is possibly due to the fact that in contrast with the above-mentioned lamps in which the electrode pin is supported by a wall of the neck-shaped portion which was allowed to collapse on – to the pin, the length of the supporting member is smaller. From a point of view of costs also the supporting member will not be chosen to be considerably longer than is necessary to obtain a stable support of the electrode pin. In general the length of the supporting member will not be larger than its largest diameter.

The supporting member is often shorter. According as the slots between the wall of the neck-shaped portion of the lamp envelope and the supporting member and between the supporting member and the electrode pin may be narrower with a view to the coefficients of expansion of the materials used, the supporting member may be chosen to be shorter. The length of the supporting member restricts the extent to which, with given gap widths, the axial direction of the supporting member may deviate from the axial direction of the neck-shaped portion of the lamp envelope. If on the basis of the thermal expansion of the materials a smaller gap width is permissible, a smaller length of the supporting member will suffice to restrict deviations in the said axial directions to the same extent.

The restriction of the deviation in axial directions has for its object to prevent the supporting member from becoming fixed in an inclined position.

Both for obtaining an optimum support and to minimize the mixing of cold gas from the neck-shaped portions of the lamp envelope with hot gas from the discharge space, the supporting members are provided as near as possible to the open ends of the neck-shaped portions.

The supporting members may be manufactured from materials which can withstand the high temperatures prevailing in the lamp during operation. As such materials may be mentioned: quartz glass, ceramic materials, such as polycrystalline $Al_2O_3$ or $MgAl_2O_4$ (Spinel), monocrystalline $Al_2O_3$, high-melting-point metals, for example tungsten, molybdenum, tantalum, titanium, and the like.

The supporting members may have a variety of shapes. The simplest is that of a circular disc or rod having a central bore for the electrode pin. For reasons of cost-price, members having this shape are preferably manufactured from quartz glass or ceramic. The use of quartz glass or ceramic members has the additional advantage that said materials are poor heat conductors as a result of which a quieter discharge arc is obtained.

If the inner diameters of the neck-shaped portions of lamps vary too considerably for each individual case, it may be desirable, after assembly of the lamp, to reduce the diameter of a neck-shaped portion at the area of the supporting member by forming a re-entrant part in the glass. When a quartz glass supporting member is used, the member might adhere to the wall, which is undesirable. Therefore, in cases in which such a treatment may be necessary, a quartz glass member is preferably used, the jacket of which is lined with a foil or coating of a high-melting-point metal, for example, molybdenum, tantalum, tungsten, titanium of a few microns thick (for example, 10–30 microns). The foil may be secured to the member by folding it about the edge of the end faces of the member.

Upon forming the re-entrant part, the glass of the wall of the necl does not adhere to a foil-lined or coated quartz member.

For economical reasons, metal supporting members are preferably not solid. They may consist of a sleeve which is closed at one or two sides and which has a central bore for the electrode pin, or it may consist of two telescoping sleeves or of a cylinder fitting the electrode pin and having a flange fitting in the neck-shaped portion.

The advantage of the members is that they consume little material, while in the last-mentioned shape, as well as in the case of the unilaterally closed cylinder, one of the slots, via which during manufacture of the lamp air is to be exhausted from the lamp, is particularly short. Said supporting members may readily be manufactured from a ceramic material. These and other shapes of suitable supporting members are described in detail in the drawings.

The invention will be described in greater detail with reference to the Figures.

Figure 1:
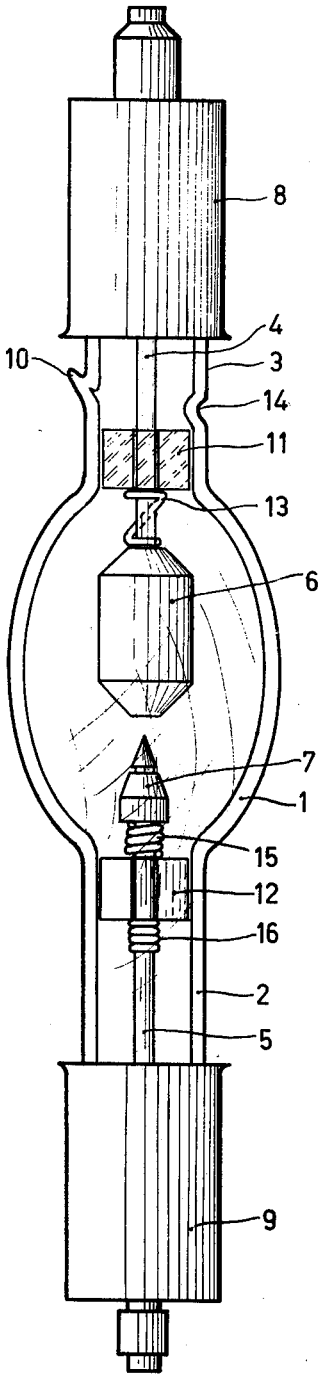
FIG. 1 is an elevation of a short-arc discharge lamp.
Figure 2:
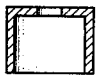
FIGS. 2 to 7 are axial sectional views through supporting members of ceramic or metal.

Reference numeral 1 in FIG. 1 denotes the part of the quartz glass lamp envelope surrounding the discharge space, 2 and 3 denote the neck-shaped portions. The tungsten electrode pins 4 and 5 supporting the anode 6 and cathode 7, respectively, of thoriated tungsten, extend via the neck-shaped portions to in the discharge space. The pins are led through the wall of the lamp envelope at the ends of the necks in a vacuum-tight manner. Caps 8 and 9 are secured to the ends of the necks and have connection possibilities for current supply wires. The exhaust tube seal is denoted by 10. A ceramic supporting member 11 supports and centres the electrode pin 4 of the anode; a quartz glass member 12 supports and centres the electrode pin of the cathode. The supporting member 11 is locked against displacement in the axial direction by a tungsten wire 13 which is wound around the electrode pin near the supporting member and near the anode. Movement in the opposite direction is impossible by a re-entrant part 14 in the wall of the neck.

The supporting member 12 is fixed at one end by a loose, wound wire 15, and at the other end by a wire 16 wound in a clamping manner. The lamp is filled with 10 atmospheres Xenon, has an electrode spacing of 3.6mm and during operation takes up a power of 1000W at 20V.

Figure 7:
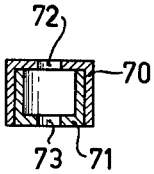

The supporting members shown in FIGS. 2 to 6 need no further description. FIG. 7 shows a member which consists of two telescoping metal sleeves 70 and 71 each having a central bore 72 and 73 for the electrode pin.

Figure 8:
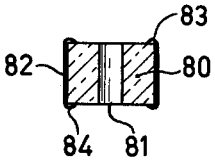
FIG. 8 is an axial sectional view through a quartz glass supporting member having a metal foil lining on the cylinder jacket.

Reference numeral 80 in FIG. 8 denotes a quartz glass supporting member having a bore 81 and a molybdenum foil 82 which is folded at 83 and 84 around the end faces of the quartz member.

Figure 3:
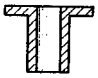
Figure 4:
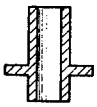
Figure 5:
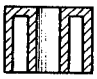
Figure 6:
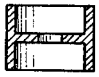

With reference to the supporting members shown in FIGS. 3 and 4 it is to be noted that these may be used so that the end comprising the flange is present in the neck-shaped portion of the lamp envelope, while the other end bears against the electrode so that movement of the member in the direction of the electrode is impossible. Fixation is necessary only against a movement in the opposite direction. The gap length via which during the manufacture the lamp envelope is to be evacuated and filled with gas is particularly small in these members.

What is claimed is:

1. A short-arc discharge lamp comprising: an envelope, two opposed electrodes, a rigid electrode pin supporting each electrode and a rare gas filling, said envelope having a portion enclosing the discharge space and two neck-shaped portions via which said electrode pins to said electrodes extends to support said electrodes, said electrode pins extending through the wall of the lamp envelope in a vacuum-tight manner said lamp further including a cylindrical supporting member disposed about each of said electrode pins within one of said neck-shaped portions said cylindrical supporting member having an inside diameter greater then said electrode pin and an outside diameter less than the inside diameter of said neck-shaped portions in which said supporting member is disposed when said lamp is not operating and means to fix the supporting member against axial displacement with respect to the electrode pin about which said supporting member is disposed, the difference in the inside diameter of said supporting member and said neck-shaped portion allowing for differential expansion with changes in temperature.

2. A short-arc discharge lamp as claimed in claim 1 wherein said supporting member is manufactured of quartz glass or ceramic material.

3. A short-arc discharge lamp as claimed in claim 2, wherein said member is quartz glass and has the shape of a disc having a central bore and has a jacket lined with a foil or coating of a high-melting point metal.

4. A short-arc discharge lamp as claimed in claim 1 wherein said supporting member consists of a unilaterally closed sleeve having a central bore.

5. A short-arc discharge lamp as claimed in claim 1 wherein each supporting member consists of a cylinder fitting around the electrode pin said cylinder having a flange fitting in one neck-shaped portion of said lamp envelope.

6. A short-arc discharge lamp as claimed in claim 4 wherein said supporting member consists of a ceramic or a high-melting-point metal.

7. A short-arc discharge lamp as claimed in claim 1 wherein said supporting member has no axially extending channels other than a single channel for said electrode pin.

* * * * *